US006449982B1

(12) United States Patent
Fischer

(10) Patent No.: US 6,449,982 B1
(45) Date of Patent: Sep. 17, 2002

(54) PROCESS FOR PARTIAL LIQUEFACTION OF A FLUID CONTAINING HYDROCARBONS, SUCH AS NATURAL GAS

(75) Inventor: Béatrice Fischer, Lyons (FR)

(73) Assignee: Institut Francais du Petrole, Cedex (FR)

( * ) Notice: Subject to any disclaimer, the term of this patent is extended or adjusted under 35 U.S.C. 154(b) by 0 days.

(21) Appl. No.: 09/764,438

(22) Filed: Jan. 19, 2001

(30) Foreign Application Priority Data

Jan. 19, 2000 (FR) ..... 00 00737

(51) Int. Cl.[7] ..... F25J 1/00
(52) U.S. Cl. ..... 62/613; 62/619
(58) Field of Search ..... 62/612, 613, 619

(56) References Cited

U.S. PATENT DOCUMENTS

| | | | |
|---|---|---|---|
| 3,690,114 A | 9/1972 | Swearingen et al. | 62/40 |
| 4,195,979 A | 4/1980 | Martin | 62/26 |
| 5,826,444 A | 10/1998 | Capron et al. | 62/612 |

FOREIGN PATENT DOCUMENTS

EP 0 599 443 A1 6/1994

*Primary Examiner*—Ronald Capossela
(74) *Attorney, Agent, or Firm*—Millen, White, Zelano & Branigan, P.C.

(57) ABSTRACT

A process for partial liquefaction of a fluid G at least partially formed from hydrocarbons simultaneously produces:

a fraction that is liquid after expansion;

a gas fraction representing at least 10% by weight, which can either be re-injected or used to produce electricity;

and comprises at least two refrigeration steps during which:

in the first step a), the essentially gaseous fluid G is cooled using an external refrigerant M such that at the end of said first step, it is at least partially liquid at the operating pressure; and in the second step b), liquefaction of said fluid G is completed if necessary and said fluid G is sub-cooled, using a portion of the same fluid G, said portion being thus expanded and vaporised to produce the cooling necessary to recover the other portion of said fluid G that is completely liquid at the storage pressure.

23 Claims, 8 Drawing Sheets

PROCESS FOR PARTIAL LIQUEFACTION OF A FLUID CONTAINING HYDROCARBONS, SUCH AS NATURAL GAS

TECHNICAL FIELD OF THE INVENTION

The present invention relates to a process and apparatus for at least partial liquefaction of a fluid or a gaseous mixture at least partially formed from a mixture of hydrocarbons, for example natural gas. Natural gas is currently produced at sites distant from where it is used and it is normally liquefied so that it can be transported over long distances, for example by a LNG tanker, or stored as a liquid. The term "natural gas" as used in the present description means a mixture formed mainly from methane, but which can also contain other hydrocarbons and nitrogen, regardless of the state it is in (gas, liquid or two-phase). The starting natural gas is mainly in the gas state, and at a pressure such that during the liquefaction stage, it can be in different states, for example liquid and gaseous, co-existing at a given time.

PRIOR ART

Prior art processes that have been used and disclosed, in particular those in United States patents U.S. Pat. No. 3,735,600 and U. S. Pat. No. 3,433,026, describe liquefaction processes principally comprising a first step during which natural gas is pre-cooled by vaporising a refrigerant mixture, and a second step that carries out the final natural gas liquefaction step, and produce a liquefied gas in a form that can be transported or stored, the cooling during that second step also being produced by vaporising a refrigerant mixture.

In such processes, a mixture of fluids used as a refrigeration fluid in the external refrigeration cycle is vaporised, compressed, cooled by exchanging heat with an ambient medium such as water or air, condensed, expanded and recycled.

The refrigerant mixture used in the second step in which the second refrigeration step is carried out is cooled by heat exchange with the ambient cooling medium, water or air, then the first step in which the first refrigeration step is carried out.

At the end of the first step, the refrigerant mixture is in the form of a two-phase fluid comprising a vapour phase and a liquid phase. Said phases are separated, for example in a separator drum, and sent, for example, to a spiral-tube heat exchanger, in which the vapour phase is condensed, while the natural gas is liquefied under pressure, cooling being ensured by vaporising the liquid fraction of the refrigerant mixture. The liquid fraction obtained by condensing the vapour fraction is sub-cooled, expanded and vaporised to ensure final liquefaction of the natural gas, which is sub-cooled before being expanded through a valve or a turbine to produce the desired liquefied natural gas (LNG).

The presence of a vapour phase necessitates carrying out a condensation operation on the refrigerant mixture at the second step and requires relatively complex and expensive equipment.

U.S. Pat. No. 4,195,979 describes adding a natural gas expansion step between the two refrigeration steps.

The Applicant's French patent FR-A-2 743 140 proposes using pressure and temperature conditions selected to produce a completely condensed single-phase refrigerant mixture at the outlet from the first refrigeration step.

This causes constraints, which can adversely affect the economics of the process; in particular, the pressure to which the refrigerant mixture used in the second step is compressed can be relatively high.

A further prior art disposition consists of operating using three refrigeration cycles in series, each being operated with a pure body as the refrigerant. A first cycle functions with propane and enables ethylene to be condensed under pressure at a temperature of about −35° C. Vaporisation of the ethylene at a pressure close to atmospheric pressure in a second cycle can condense methane below a temperature of about −100° C. Vaporising the methane can sub-cool the liquefied natural gas (LNG) produced and thus expands it to enable it to be stored and transported at a pressure close to atmospheric pressure. This modus operandum has the disadvantage of having to use substantially pure ethylene which then has to be vaporised to condense substantially pure methane which is then itself vaporised to sub-cool the LNG. The use of a substantially pure body deleteriously affects the process costs and the use of ethylene, a particularly reactive unsaturated compound, necessitates taking particular precautions that also deleteriously affect the process costs.

DISCLOSURE OF THE INVENTION

The present invention concerns a process for partial liquefaction of a fluid G or a gaseous mixture at least partially formed from hydrocarbons, such as a natural gas NG, and an apparatus for carrying out this process. The process of the present invention at least partially overcomes the disadvantages cited in the prior art.

More precisely, the present invention concerns a process for partial liquefaction of a fluid G at least partially formed from hydrocarbons simultaneously producing a fraction that is liquid after expansion and a gaseous fraction representing at least 10% by weight, preferably 20% by weight, more preferably at least 30% by weight with respect to the weight of fluid G initially introduced into said process, and comprises at least two refrigeration steps during which:

in the first step a), the essentially gaseous fluid G is cooled using an external refrigerant M such that at the end of said first step, it is at least partially liquid, preferably completely liquid at the operating pressure, preferably about 4 to about 7 MPa; and in the second step b), liquefaction of said fluid G is completed if necessary and said fluid G is sub-cooled, using a portion of the same fluid G, said portion being thus expanded and vaporised to produce the cooling necessary to recover the other portion of said fluid G that is completely liquid.

In a first variation, at least a portion of the gaseous fraction, representing at least 20% by weight with respect to the weight of the fluid G initially introduced into said process, can be used to produce electricity.

In a second variation, at least a portion of the gaseous fraction, representing at least 20% by weight with respect to the weight of the fluid G initially introduced into said process, can be re-injected into the zone from which it is recovered, and particularly in the case where the fluid G is a natural gas, into the well from which it is recovered.

The first refrigeration step comprises a plurality of heat exchange zones, for example, and cooling can be carried out in said successive heat exchange zones using an external refrigerant M that is expanded and vaporised at decreasing pressures. In a particular implementation of the invention, fluid G leaves the first refrigeration step as a single condensed phase. In a further implementation of the invention, fluid G leaves the first refrigeration step as a dense phase.

The external refrigerant M comprises at least one hydrocarbon, preferably at least two hydrocarbons. The hydrocarbon or hydrocarbons are preferably selected from the group formed by methane, ethane, propane and butanes. In a particular implementation of the process of the invention, the external refrigerant M comprises methane, ethane, propane and at least one butane.

The second step comprises a single exchange zone, for example, in which the liquefied fluid G is sub-cooled. At the outlet from this exchange zone, the liquefied gas is separated into two portions: a portion being sent to storage after expansion, the other portion being expanded and returned to the same exchange zone to produce, by vaporisation, the cooling necessary for the sub-cooling and optionally, when fluid G entering said second step is not completely liquid, to produce total liquefaction of said fluid G. In a particular implementation, the portion of fluid G used to produce the cooling necessary for this second step is vaporised at different decreasing pressures.

A preferred option for the second step is as follows: the liquefied gas is expanded to an intermediate pressure in the range 0.3 to 1.2 MPa at the outlet from the second step using either a liquid turbine or a Joule-Thomson valve. Fluid G is completely liquid after this first expansion. Fluid G is then separated into two substantially equal portions: one portion is normally sent to cryogenic storage after expansion, optionally after a denitrogenation step comprising partial revaporisation, a portion of the remainder being returned at the intermediate pressure and the other portion at a lower pressure to step b) to produce the cooling necessary for sub-cooling, and optionally when fluid G entering said second step is not completely liquid, for total liquefaction of said fluid G.

The operating conditions for the process of the invention are preferably selected such that the quantity of liquefied gas obtained is about 20% to about 80% by weight, more preferably about 30% to about 70% by weight of the quantity of gas entering the process.

BRIEF DESCRIPTION OF THE FIGURES

The invention will be better understood from the following simplified, non-limiting figures that illustrate several implementations of the process, wherein.

DETAILED DESCRIPTION OF FIGS. 1 TO 5.

Figure 1:
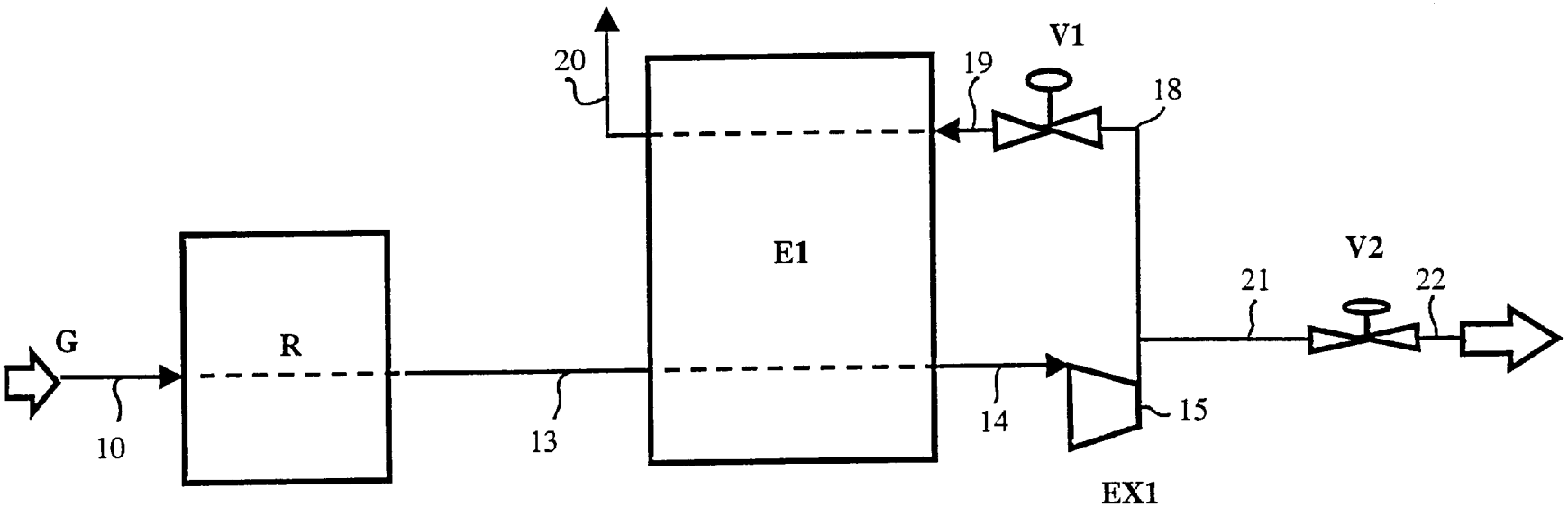
FIGS. 1 and 2 show the two options for the flowsheet for the unit of the invention, FIG. 2 showing a preferred option.

In accordance with the process of the invention (flowsheet of FIG. 1), which is one of the most simple implementation options of the process:

a) natural gas (G in FIGS. 1 to 5, 7 and 8) is cooled in the pre-cooling portion (R) in which it enters via line (10) and leaves, preferably completely liquid (from this first refrigeration step) via line (13) at a lower temperature of about −40° C., preferably about −50° C. to about −80° C.

b) the liquid circulating in line (13) is sub-cooled in exchanger E1 and at the outlet from this exchanger enters via line (14) into liquid expansion turbine EX1 in which it is expanded (the turbine can be replaced by a valve, for example). The product obtained from turbine EX1 circulating in line (15) is completely liquid.

c) A portion of the product obtained from turbine EX1 is sent via line (21) through valve V2 in which it is expanded then sent via line (22) either to a denitrogenation section, or directly to cryogenic storage.

d) The remainder of the product obtained from turbine EX1 is sent via line (18) to valve V1 in which it is expanded to a low pressure before being sent to exchanger E1 via line (19). This fluid vaporises in exchanger E1 to provide the cooling necessary for sub-cooling the liquid circulating in line (13) passing through this exchanger. This fluid leaves, completely vaporised, via line (20).

In a preferred option of the invention (simplified flowsheet of FIG. 2):

e) natural gas G is cooled in pre-cooling portion (R) that it enters via line (10) and preferably leaves completely liquid via line (13) at a lower temperature of about −40° C., preferably about −50° C. to about −80° C.

f) the liquid circulating in line (13) is sub-cooled in exchanger E1 and at the outlet from this exchanger enters via line (14) into liquid expansion turbine EX1 in which it is expanded (the turbine can be replaced by a valve). The product obtained from turbine EX1 circulating in line (15) is completely liquid.

g) a portion of the product obtained from turbine EX1 is sent via line (21) through valve V2 in which it is expanded then sent via line (22) either to a denitrogenation section T1 from which a purge is recovered via line (24) and liquefied natural gas via line (23). A further possibility is to send the product circulating in line (22) directly to cryogenic storage.

h) The remainder of the product obtained from turbine EX1 is separated into two portions. A portion of this product is sent via line (16) directly to exchanger E1, while the other portion is sent via line (18) to valve V1 in which it is expanded before being sent to exchanger E1 via line (19). The two portions of this fluid, which are at different pressures, vaporise in the exchanger at different temperatures, to produce on the cold side an enthalpic curve that closely follows that of the fluid to be cooled, and thus to produce a low specific power.

i) At the outlet from exchanger E1, the two portions of this vaporised fluid are sent via lines (17) and (20) respectively to two different stages of the compressor K1, which increases the pressure of the gas leaving this compressor via line (25), to a level sufficient for use, for example in gas turbines generating electricity.

Figure 2:
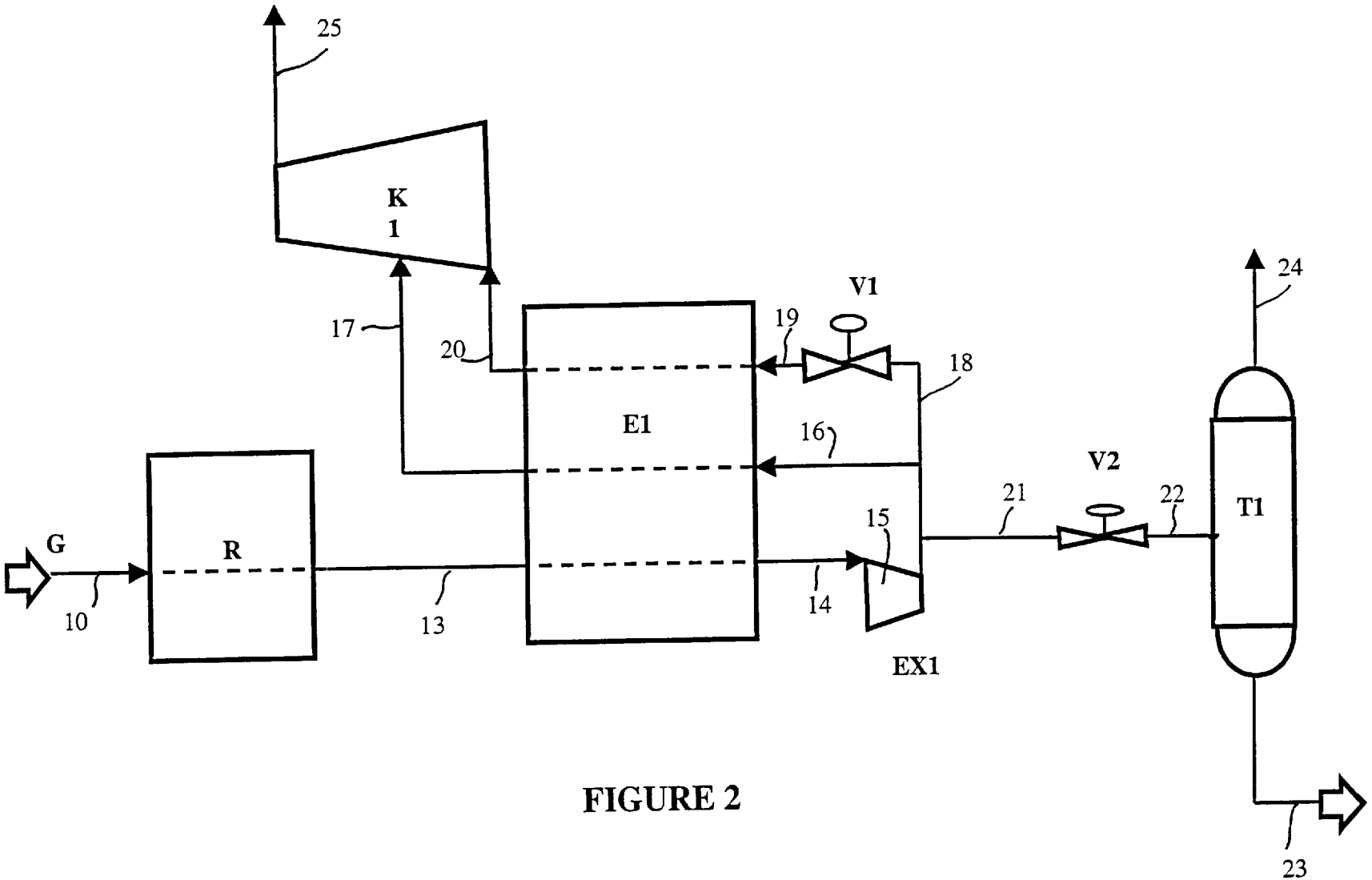
Figure 8:
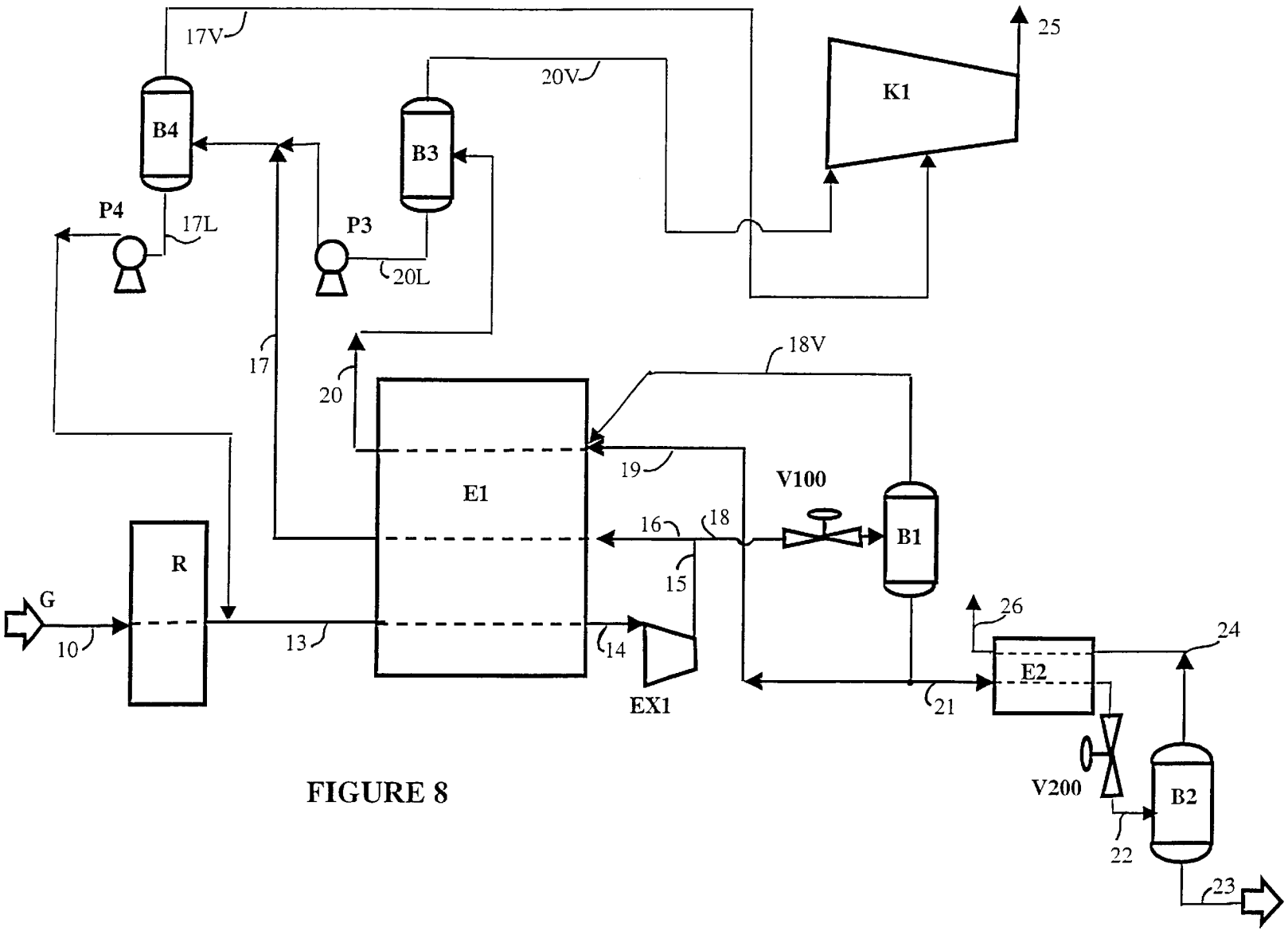

In this embodiment illustrated in FIG. 2, the liquefied portion of fluid G circulating in line (21) (hereinafter designated by the term "the other portion") is expanded and partially vaporised in one step up to the storage pressure. In a further embodiment, for example as shown in FIG. 8, the liquefied portion of fluid G circulating in line (18) (hereinafter designated by the term "the other portion") is expanded and partially vaporised in two steps to the storage pressure.

In this configuration, the process can liquefy about 50% by weight of the gas at the inlet, while 50% by weight leaves in the form of a gas at a lower pressure than that at which it enters. An example below will show that the specific power per unit of liquefied gas is close to 600 kilojoules per kilo (kJ/kg), which is much lower than the normal specific powers (about 1000 kJ/kg). It has also been shown that equipment costs are substantially reduced compared with those of existing liquefaction units. This configuration could be applied when conjointly with liquefaction, there is a power station functioning, for example, from a natural gas turbine, the compressors for liquefaction will then be driven by a small portion of the electricity produced by the station. It has been calculated that with this configuration, an amount of 300 megawatts (MW) could be associated with liquefaction of 0.4 millions of tonnes per year, consuming about 8 MW. The process could also be associated with a scheme comprising re-injection of the gas as described above.

Figure 3:
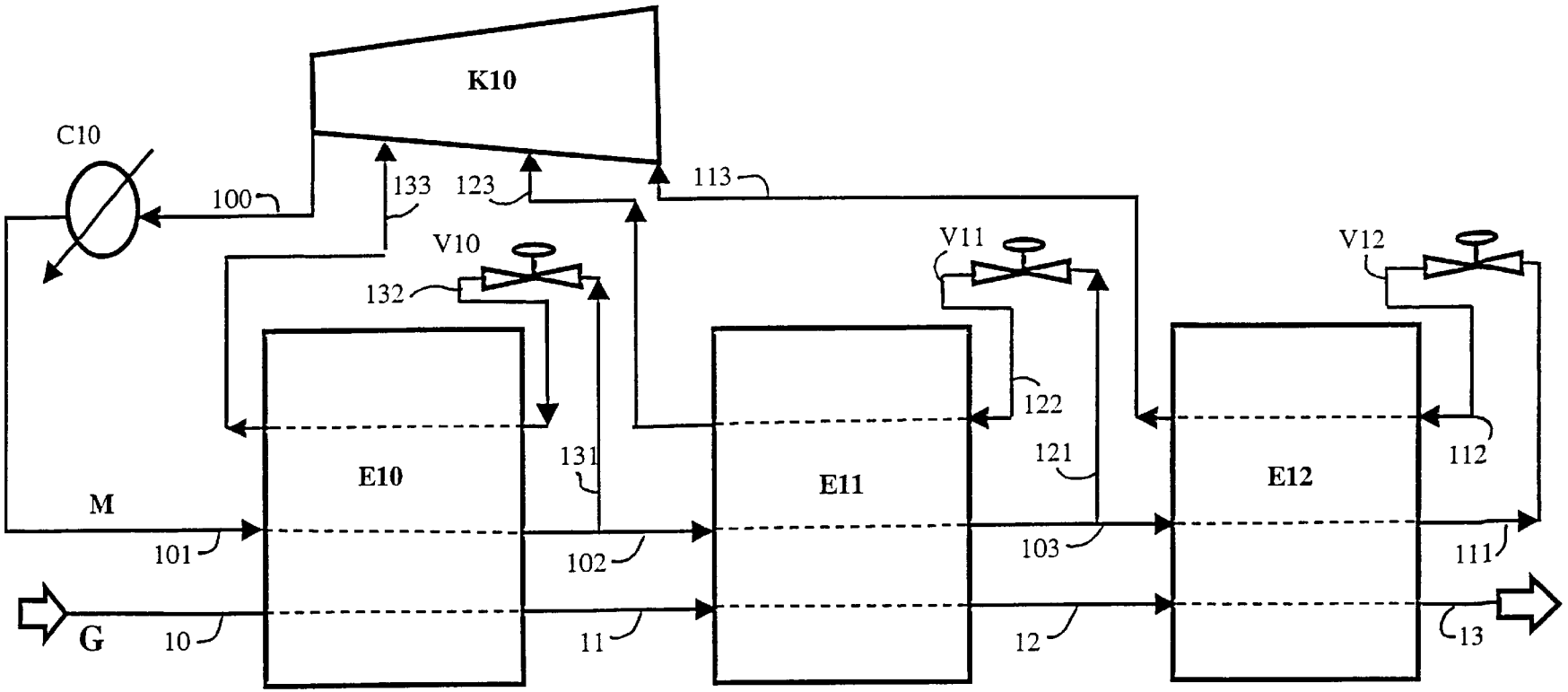
FIG. 3 shows a possibility for carrying out the first refrigeration step.

The non-limiting simplified flowsheet shown in FIG. 3 illustrates how pre-cooling of gas (R) can be carried out. Gas G must be almost completely liquefied at the end of this step, which means that the pressure must be made lower than with a propane cycle. A refrigerant mixture M is thus used, principally comprising ethane and propane, and a smaller quantity of methane and butanes. Gas G enters gas pre-cooling section (R) via line (10) and is cooled and liquefied successively in exchange zones E10, E11 and E12, from which it leaves by lines (11), (12) and (13) respectively. In line (13), fluid G is practically completely liquefied. The refrigerant mixture M is compressed by compressor K10, which it leaves via line (100). It is condensed by condenser C10, from which it leaves via line (101) at the bubble point and part of which is sent to exchange zone E10 where it is sub-cooled. It leaves exchange zone E10 via line (102) and part of it is sent to exchange zone E11. A further portion of refrigerant mixture M circulating in line (102) is removed and sent via line (131) to valve V10 in which it is expanded then re-introduced into exchange zone E10 via line (132) where this refrigerant mixture M is vaporised to produce the cooling required in this zone.

In the same manner, part of the refrigerant mixture M leaving exchange zone E11 is sent to exchange zone E12 via line (103). A further portion of the refrigerant mixture M circulating in line (103) is removed and sent via line (121) to valve V11 in which it is expanded then returned to exchange zone E11 via line (122) where it is vaporised to produce the cooling required in this zone. The refrigerant mixture leaves the exchange zone E12 via line (III), it traverses valve V12 in which it is expanded, then sent via line (112) to exchange zone E12 where it is vaporised to produce the cooling in this zone. Valves V10, V11 and V12 expand the refrigerant mixture M at decreasing pressures corresponding to the decreasing vaporisation temperatures in the three exchange zones E10, E11 and E12. The vaporised refrigerant mixture from the outlet from the three exchange zones E10, E11 and E12 is sent to three different stages of compressor K10 via lines (133), (123) and (113) respectively.

Figure 4:
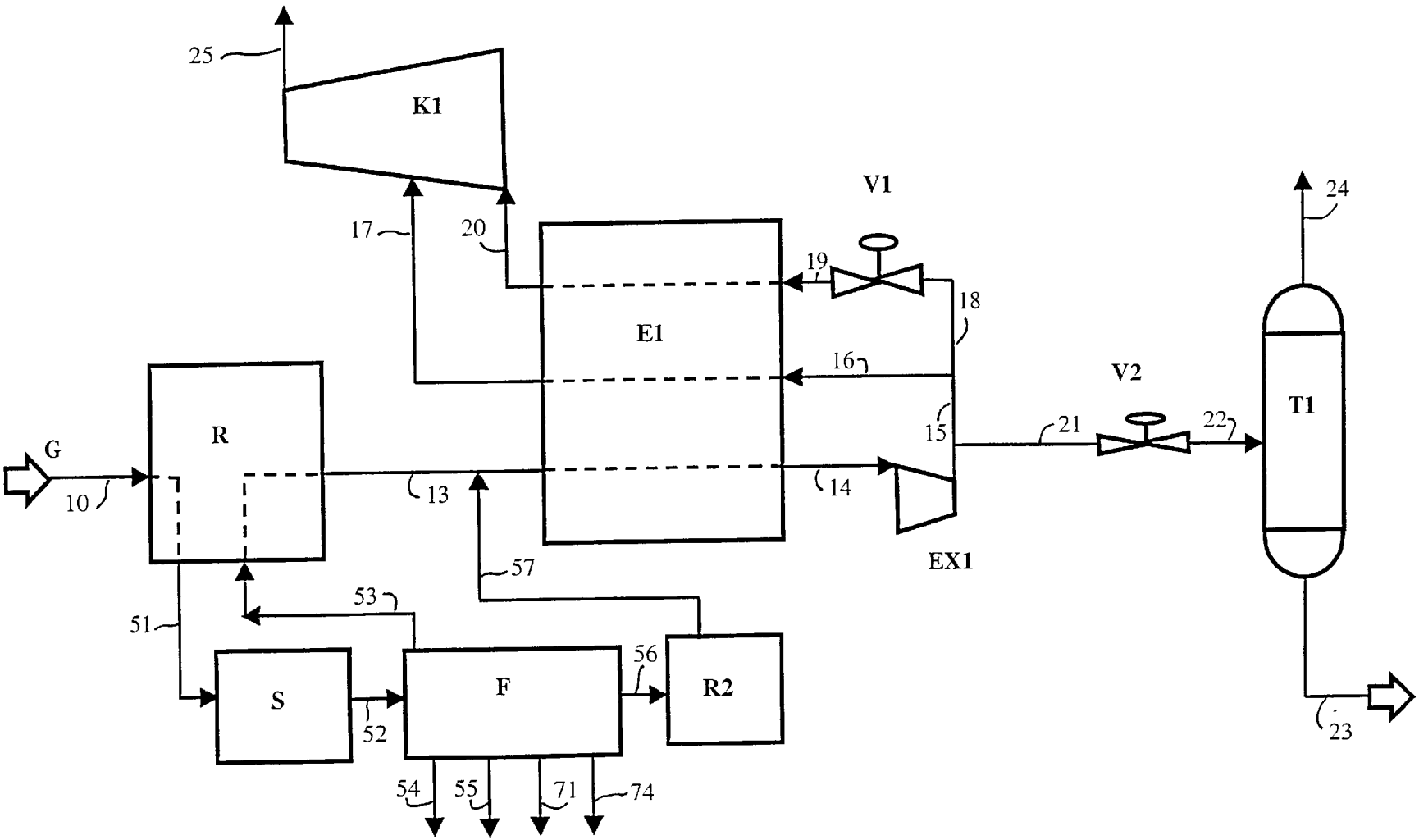
FIG. 4 shows an implementation of the process integrating gas fractionation.

The non-limiting simplified flowsheet shown in FIG. 4 illustrates the manner in which natural gas drying and fractionation can be integrated to remove fractions that are too heavy and to produce makeups for the refrigerant mixture. Natural gas G enters via line (10) into pre-cooling section (R) which it leaves via line (51) and is then sent to the drying section (S). Dry gas leaves drying section (S) via line (52) and is sent to fractionation section F. The following leave this section F:

- fuel gas via line (54);
- stabilised condensates leave via line (55), containing pentanes, all of the hexane, benzene and any heavier compounds;
- a cut principally containing ethane leaves via line (71) and a cut principally containing propane leaves via line (74). These two cuts are used as a makeup to compensate for leakage of refrigerant mixture M;
- via line (53), a gas that has been purified of heavy compounds is recovered and sent to the pre-cooling section (R);
- a mixture principally containing ethane, propane and butanes is sent via line (56) to the pre-cooling section (R2) and is subsequently re-mixed with gas to be liquefied leaving pre-cooling section (R).

The purified gas from fractionation section F is cooled and liquefied in pre-cooling section (R); it leaves this section via line (13) and is mixed with cooled fluid leaving pre-cooling section (R2) via line (57). The mixture is sent to exchange zone E1 where it is sub-cooled. The remainder of the flowsheet is identical to that described above regarding FIG. 2.

Figure 5:
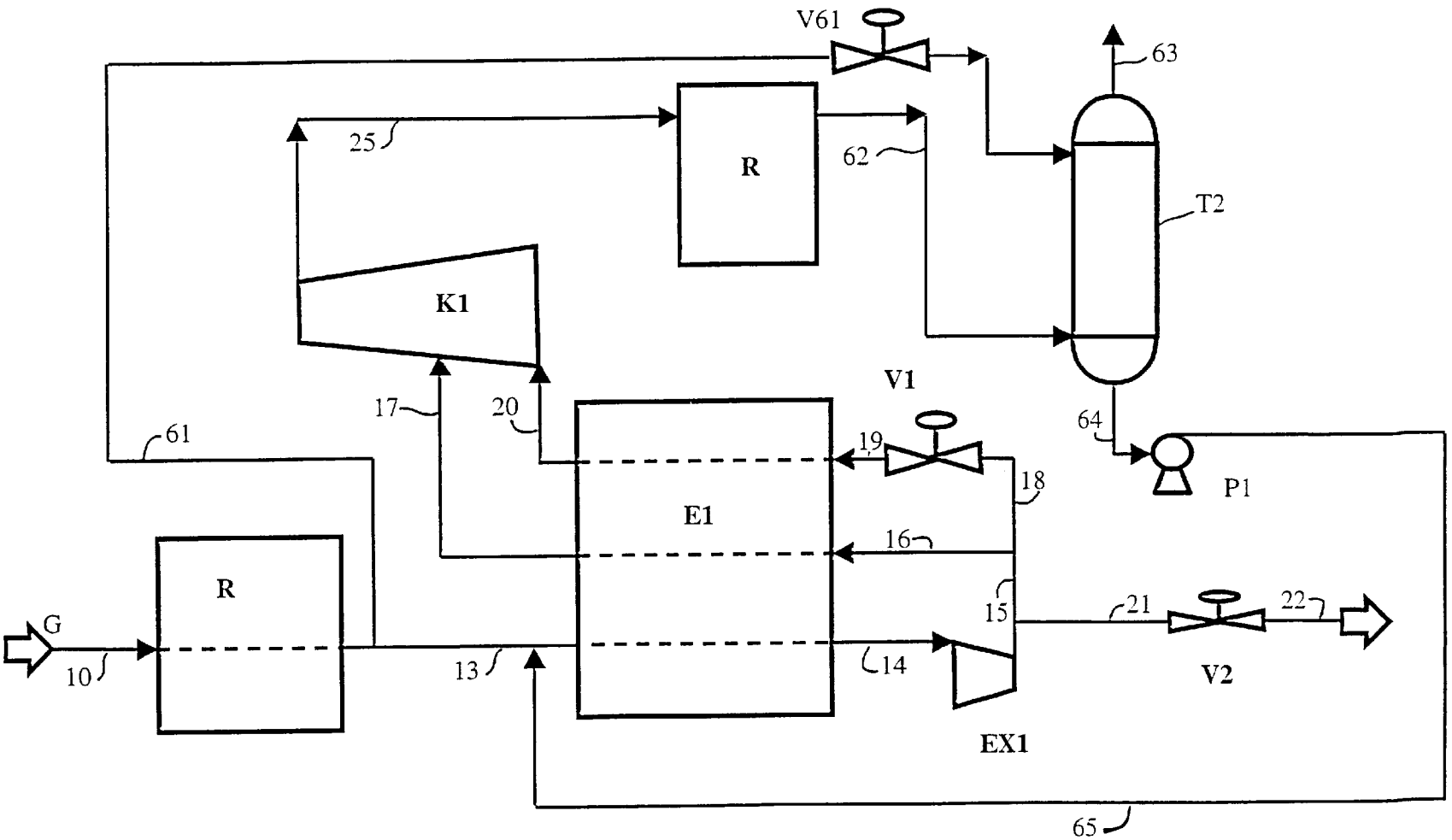
FIG. 5 shows a variation of the process that can increase recovery of C2+ compounds in the liquefied portion of fluid G.

The simplified flowsheet of FIG. 5 shows a variation for recovering almost all of the C2+ compounds (i.e., compounds containing at least two carbon atoms, such as ethane, propane, butanes, etc.) present in the liquefied natural gas. The gas leaving compressor K1 via line (25) and intended to be burned in turbines is first cooled using the pre-cooling section (R), then sent via line 62 to the bottom of a fractionation column T2. At the head of column T2, a small portion of the cooled and liquefied natural gas leaving pre-cooling section (R) via line (61) is expanded in valve V61 before being introduced to the head of column T2. The overhead gas leaving column T2 via line (63) is purified of most of the C2+ compounds. The liquid at the bottom of column T2 contains a small portion of methane, but mainly ethane, propane and heavier hydrocarbons. This liquid is sent to pump P1 via line (64). The liquid circulating in line (65) from pump P1 is at a sufficient pressure to be re-mixed with liquefied fluid G from line (13).

As an example, for a natural gas containing 76 mole % of methane, the amount of methane in the fuel gas at the head of T2 will be of the order of 90 mole %, and the amount of methane in the liquefied natural gas will be 64 mole %. The remainder of the scheme is identical to that which has been described above regarding the illustration shown in FIG. 2.

In summary, the process of the invention is a process for partial liquefaction of a fluid G at least partially formed from hydrocarbons simultaneously producing:

- a fraction that is liquid after expansion;
- a gaseous fraction representing at least 10% by weight with respect to the weight of fluid G initially introduced into said process;
- and comprising at least two refrigeration steps during which:
  - in the first step a), the essentially gaseous fluid G is cooled using an external refrigerant M such that at the end of said first step, it is at least partially liquid at the operating pressure; and
  - in the second step b), liquefaction of said fluid G is completed if necessary and said fluid G is sub-cooled, using a portion of the same fluid G, said portion being thus expanded and vaporised to produce the cooling necessary to recover the other portion of said fluid G that is completely liquid.

In a preferred variation, at least a portion of the gaseous fraction representing at least 10% by weight with respect to the weight of the fluid G initially introduced into said process can be used to produce electricity.

In a further preferred variation, at least a portion of the gaseous fraction representing at least 10% by weight with respect to the weight of the fluid G initially introduced into said process is re-injected into the zone from which it is recovered, and in the case where the fluid G is a natural gas, into the well from which it is recovered.

Preferably, the other liquefied portion of fluid G is expanded and partially vaporised in one or two stages to the storage pressure.

Preferably, the portion of fluid G used to produce the cooling necessary for the second step is vaporised at different decreasing pressures.

More preferably, the operating conditions are selected such that the quantity of liquefied gas obtained is about 20% to about 80% by weight of the quantity of gas at the process inlet.

In a preferred variation, the first refrigeration step comprises a plurality of heat exchange zones and cooling is carried out in said heat exchange zones using external refrigerant M which is expanded and vaporised at decreasing pressures.

Preferably, external refrigerant M comprises at least one hydrocarbon, preferably at least two hydrocarbons.

More preferably, external refrigerant M comprises at least one hydrocarbon selected from the group consisting of: methane, ethane, propane and butanes. Still more preferably, external refrigerant M comprises methane, ethane, propane and at least one butane.

Preferably, fluid G leaves the first refrigeration step as a condensed single phase. More preferably, fluid G leaves the first refrigeration step as a dense phase.

In a further variation, fluid G is at a temperature that is at least less than about −40° C. at the outlet from the first refrigeration step.

In a preferred implementation of the process of the invention, the vaporised portion of fluid G in the second step of the process is compressed to a sufficient pressure to allow its re-injection into the zone from which it is recovered and in the case where the fluid G is a natural gas, into the well from which it is recovered.

In a further preferred mode of the process of the invention, the vaporised portion of fluid G in the second step of the process is compressed to a sufficient pressure to enable it to be used to produce electricity, in particular in a gas turbine. Preferably, the portion of fluid G compressed to a pressure sufficient for its use in a gas turbine is cooled using the first pre-refrigeration step then sent to the bottom of a fractionation column into the head of which a portion of the same fluid G cooled in the first pre-refrigeration step and expanded has also been introduced.

The liquefaction process of the invention can optionally also comprise a drying step and a natural gas fractionation step comprising at least two fractionation columns, said fractionation being carried out immediately after drying, by supplying the first fractionation column at the drying temperature, and using the second exchange zone of the first refrigeration step as the condenser for said column.

More preferably, the product leaving the bottom of the first fractionation column is cooled in the pre-cooling section using external refrigerant M used in the first pre-refrigeration step, before being expanded and sent to the head of the second fractionation column.

EXAMPLE

Figure 6:
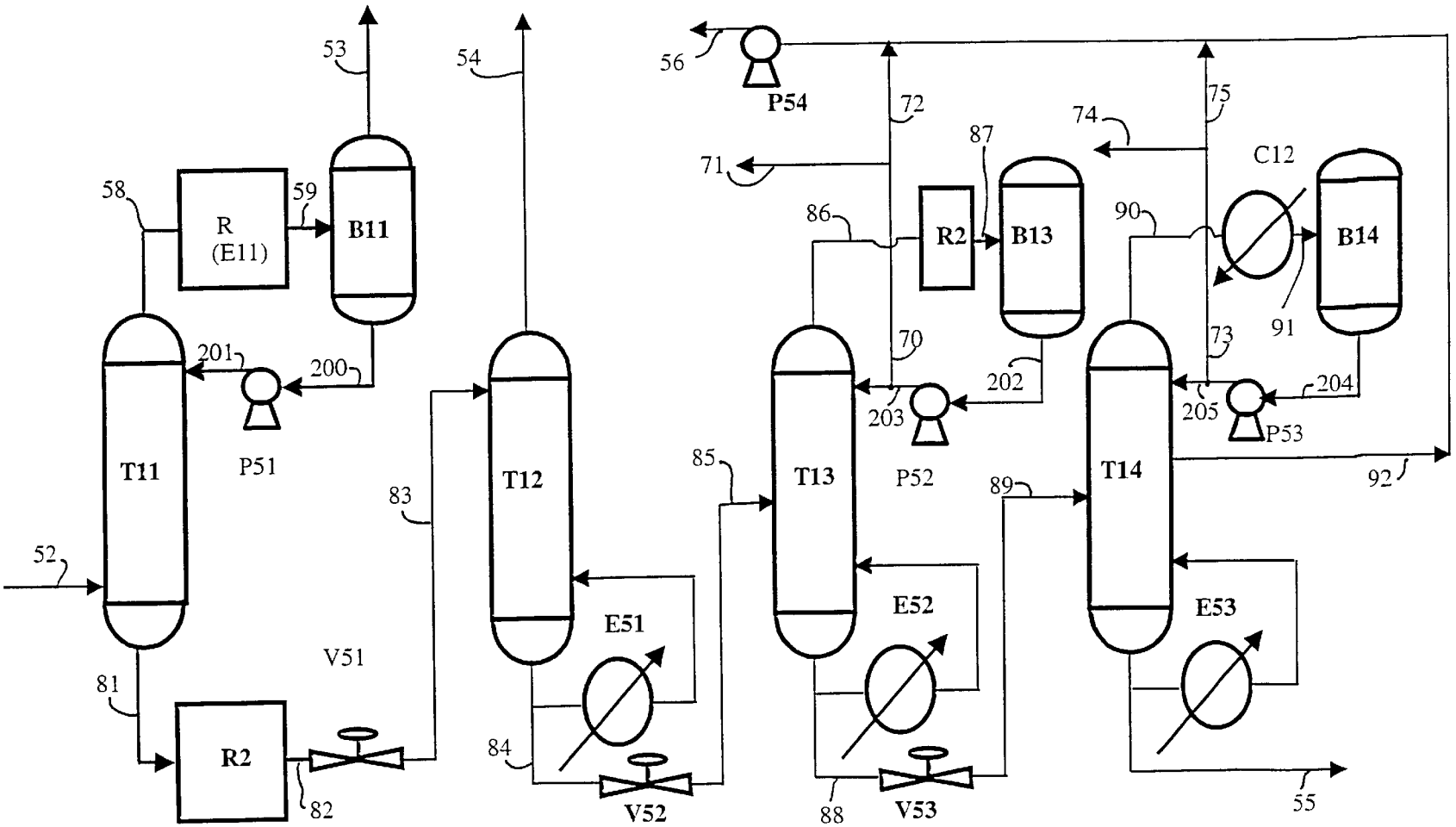
FIGS. 6 to 8 will be described below.
Figure 7:
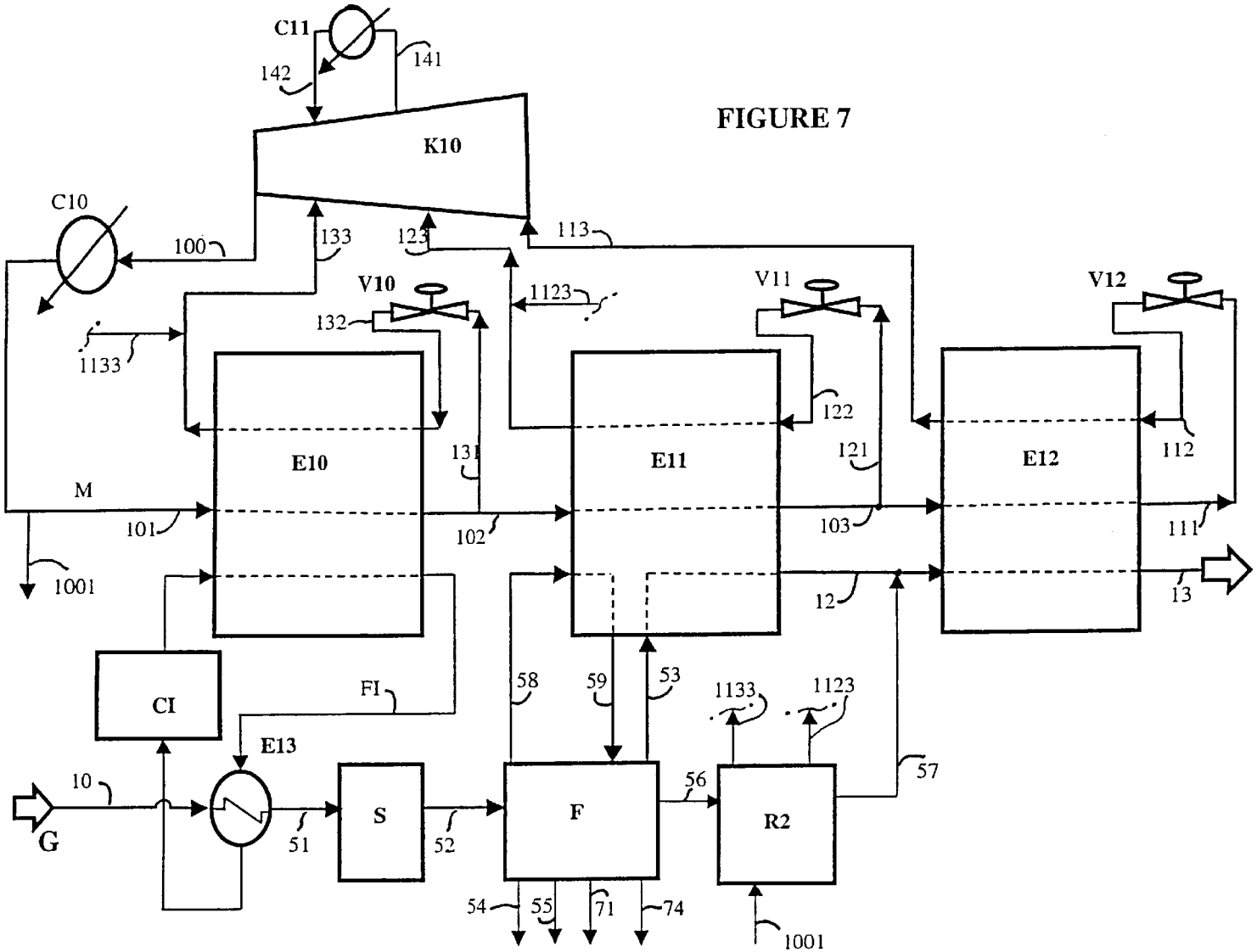

The process of the invention is illustrated by the following numerical example, described in relation to the flowsheets of FIGS. 6, 7 and 8. In this example, the first pre-refrigeration step (R) is as shown in the flowsheet of FIG. 7, fractionation (F) is as shown in the flowsheet of FIG. 6, and the second step of the process in accordance with the present invention, carried out at low temperature and after step R, is shown in the flowsheet of FIG. 8.

Consider 10000 kilomoles per hour (kmol/h) of natural gas with the following composition, in mole % after deacidification and drying:

| | |
|---|---|
| Nitrogen | 0.1 |
| Methane | 76.5 |
| Ethane | 12.7 |
| Propane | 7.8 |
| Isobutane | 1.2 |
| n-butane | 1.0 |
| Isopentane | 0.25 |
| n-pentane | 0.15 |
| C6+ | 0.3 |

This gas arrived in a liquefaction unit at a pressure of 5.6 MPa and a temperature of 40° C. A temperature of 40° C. was also assumed for the process side of the water exchangers.

FIG. 7 shows the start of the description:

Natural gas G was supplied via line (10) to exchanger E13 in which it was cooled by an intermediate fluid (F1), to a temperature of 19° C. then sent to dryer (S) via line (51) before entering fractionation zone (F) via line (52). This fractionation zone normally comprises at least two fractionation columns. The intermediate fluid F1 was driven by circulation system CI and cooled in exchange zone E10 of pre-cooling section (R).

Fractionation F (see the simplified flowsheet of FIG. 6) comprised a first column T11. The dry gas was sent to the bottom of column 11 via line (52). This dry gas entered column T11 at the temperature at which it left the drying section. The fraction leaving column T11 overhead was sent via line (58) at a temperature of 12° C. to exchange zone E11 of the pre-cooling section (R) from which it left, partially condensed, at a temperature of −0.5° C. before being sent via line (59) to reflux drum B11. Pump P51 could return, via line 201, the liquid fraction separated in drum B11 and leaving via line 200 to column T11 and thus ensure reflux in the column. The gas leaving drum B11 via line (53) was purified of cuts that were too heavy, in particular benzene. The gas was sent via line (53) (see FIG. 7) to exchange zone E11 where it was cooled to −25° C. before being sent to exchange zone E12 via line (12). The liquid leaving via line (81) (FIG. 6) from the bottom of column T11 comprised sufficient C2 and C3 compounds (compounds comprising respectively 2 and 3 carbon atoms) to make up the refrigerant mixture. This liquid mixture circulating in line (81) was sent to the pre-cooling section (R2) from which it left, cooled, via line (82), then it was expanded in valve V51 and sent to the head of column T2 (demethaniser) via line (83). This column was re-boiled using reboiler E51 to eliminate the majority of the methane from the mixture. The gas leaving column T12 overhead via line (54), rich in methane, was re-mixed with the remainder of the fuel gas leaving compressor K1 via line (25) (see FIG. 8). The product leaving the bottom of column T12 via line (84) (see FIG. 6) was sent, after expanding in valve V52, via line (85) to column T13. This column was re-boiled using exchanger E52. The gas leaving column T13 overhead (FIG. 6) via line (86) was cooled using a portion of the refrigerant mixture M in the pre-cooling section (R2), from which it left via line (87) completely condensed, before being supplied to reflux drum B13. Pump P52 could send the liquid leaving drum B13 via line (202) to column T13 via line (203) and thus ensure reflux in this column. A portion of the liquid containing a C2 cut circulating in line (203) was recovered in line (70), then separated into two portions a first portion of which was recovered via line (71) (FIGS. 6 and 7) partially acted as makeup for the refrigerant mixture M, and the other portion was sent via line (72) to be mixed with the other fractionation products circulating respectively in lines (75) and (92), then pumped via pump P54 to be sent via line (56) to pre-refrigeration step R2, and rejoined the gas to be liquefied (12) on leaving this pre-cooling section R2 via line (57) (see FIGS. 6 and 7). The product leaving the bottom of column T13 via line (88) was expanded in valve V53 before being sent via line (89) to column T14, re-boiled by exchanger E53. The gas leaving column T14 overhead (FIG. 6) via line (90) was completely condensed by water condenser C12, then sent via line (91) to reflux drum B14. Pump P53 could send liquid leaving drum B14 via line (204) to column T14 via line (205) and then ensure reflux in this column. A portion of the liquid containing a C3 cut circulating in line (205) was recovered via line (73) then separated into two portions, the first portion of which was recovered via line (74) (FIGS. 6 and 7) which partially acts as makeup for refrigerant mixture M, and the other portion of which was sent via line (75) to re-join the natural gas to be liquefied (12) via pump P54, line (56), pre-refrigeration step R2, and line (57) (see FIGS. 6 and 7). The product leaving the bottom of column T14 via line (55) was a stabilised C5+ cut (i.e., a cut containing hydrocarbons containing at least 5 carbon atoms), and that obtained by sidestream extraction from column T14 via line (92), a C4 cut containing C3 and C5 compounds which was re-mixed with the C2 cut circulating in line (72) and the C3 cut circulating in line (75). The mixture obtained was sent via pump P54 and line (56) (see FIGS. 6 and 7) to pre-cooling section R2 to be cooled to −25° C. using a portion of refrigerant mixture M removed from the outlet from condenser C10 and entering this section via line (1001). The cooled mixture left this pre-cooling section R2 via line (57) then was mixed with the cooled and liquefied gas circulating in line (12) before being sent to exchange zone E12. The portion of the refrigerant mixture M entering the pre-cooling section R2 via line (1001) was cooled, separated and expanded at two pressures to produce the cooling required for cooling the mixture arriving in said section via line (56). At the outlet from the pre-cooling section R2, the different vaporised portions leaving via lines (1123) and (1133) respectively were returned with the fluids at the same pressure, entering compressor K10 via lines (123) and (133) respectively.

Pre-cooling section R (simplified flowsheet in FIG. 7) used a refrigerant mixture M with the following composition, as a mole %:

| | |
|---|---|
| Methane | 1.9 |
| Ethane | 46.5 |
| Propane | 44.0 |
| Isobutane | 4.9 |
| n-butane | 2.7 |

This mixture left compressor K10 via line (100) compressed to a pressure of 3.23 MPa. Intermediate cooling C11 was necessary to return the fluid leaving via line (141) from the second stage of the compressor K10 to 40° C. before introducing it via line (142) to the third stage of compressor K10. The mixture circulating in line (100) was cooled to a temperature of 40° C. by exchanger C10 from which is left completely condensed via line (101). A small portion of mixture M was sent via line (1001) to pre-cooling zone R2, the remainder was sent to heat exchange zone E10. It was sub-cooled successively in heat exchange zones E10, E11 and E12. A portion was sent via line (102) from the outlet from exchanger E10 to exchanger E11. A further portion of this refrigerant mixture was sent via line (131) to expansion valve V10 in which it was expanded then re-introduced via line (132) into heat exchange zone E10 where it was vaporised and was then returned to compression system K10 at a pressure of 1.61 MPa via line (133).

In the same manner, part of the refrigerant mixture M leaving the exchange zone E11 was sent to exchange zone E12 via line (103). A further portion of the refrigerant mixture M circulating in line (103) was removed and sent via line (121), to valve V11 in which it was expanded then re-introduced into exchange zone E11 via line (122) where it was vaporised to provide the cooling necessary for this zone.

The refrigerant mixture left exchange zone E12 via line (11), traversed valve V12 where it was expanded, then was sent via line (112) to exchange zone E12 where it was vaporised to provide the cooling for this zone.

The portion of the mixture entering exchange E11 via line (122) in which it was vaporised was sent to compressor K10 via line (123) at a pressure of 0.655 MPa. The portion of the mixture entering via line (112) into exchanger E12 in which it was vaporised was sent via line (113) to the first stage of compressor K10 at a pressure of 0.15 MPa.

At the outlet from pre-cooling section R, for 10000 kmoles/h of natural gas at the inlet, the following was obtained (ignoring the makeup flow rate of the refrigerant mixture circulating in lines 71 and 74):

- 99 kmoles/h of fuel gas (leaving via line 54 (FIGS. 6 and 7)), overhead in column T2 (FIG. 6) at a temperature of −14° C., and at a pressure of 3 MPa;
- 49 kmoles/h (leaving via line 55) of stabilised C5+, from the bottom of column T14 (FIGS. 6 and 7); and
- 9852 kmoles/h were sent to exchanger E1 via line (13) (the flow rate of the liquid circulating in line 13 was equal to the sum of the flow rates of the fluids circulating in lines 12 and 57) in a completely condensed form at a temperature of −64.5° C. and at a pressure of 5.58 MPa.

The total energy consumption for the compressors in this pre-cooling section R (illustrated in FIG. 7 and symbolised by R in FIG. 8) was 15526 kW.

The liquefied natural gas circulating in line (13) entered cryogenic exchanger E1 (see the it flowsheet in FIG. 8) where it was sub-cooled and left via line (14) at a temperature of −142.5° C. It was then expanded in expansion turbine EX1 to a pressure of 0.65 MPa at which it was completely liquid at a temperature of −143.2° C. and left this expansion turbine via line (15). A portion of the fluid circulating in line (15) was sent via line (16) at this pressure to cryogenic exchanger E1 in which it vaporised. The remainder of this fluid (hereinafter designated by the term "the other portion") was sent via line (18) to valve V100 in which it was expanded then sent to drum B1 at a temperature of −144.9° C. and at a pressure of 0.26 MPa. A portion of the liquid in drum B1 was returned via line (19) mixed with the vapour from drum B1 and circulating in line (18V) in cryogenic exchanger E1 for vaporisation therein. The other portion of this liquid was sent via line (21) to exchanger E2 in which it was cooled before being expanded in valve V200 and sent to drum B2 via line (22) at a pressure of 0.105 MPa and at a temperature of −157.6° C. The vapour from drum B2 was returned via line (24) to exchanger E2: the flow rate of the vapour at the outlet from exchanger E2 (line 26, FIG. 8) was 544 kmoles at a temperature of −146.7° C.

Liquefied natural gas left the bottom of drum B2 via line (23) with a flow rate of 4985 kmoles/h, i.e., substantially 50 mole % of the natural gas flow rate entering the liquefaction unit with a molecular weight of 23.34, i.e., a weight of 116.35 tonnes/h.

The gas vaporised at low pressure left cryogenic exchanger E1 via line (20) at a temperature of −66° C. It was sent via this line to drum B3 where the non vaporised fraction was separated and sent via line (20L) to drum B4 via pump P3. The gas vaporised at a higher pressure leaving cryogenic exchanger E1 was sent to drum B4 via line (17). The liquid (17L) separated in drum B4 was pumped via pump P4 and sent as a mixture with fluid (13) to the inlet to cryogenic exchanger E1. The vapour phases from drums B3 and B4 (circulating in lines 17V and 20V respectively) were sent to the different stages of compressor K1 for compression to a pressure of 1.5 MPa. The outlet from compressor K1, line (25), contained 4315 kmole/h at a temperature of 22° C.

The energy consumption for this low temperature subcooling section was 3820 kW for compressor K1, plus 108 kW for pumps P3 and P4.

In total, the energy consumption for natural gas liquefaction was 15526+3820+108=19454 kW for 116.35 tonnes/h of LNG, i.e., 602 J/g of LNG.

What is claimed is:

1. A process for partial liquefaction of a fluid G at least partially formed from hydrocarbons comprising:

a) Cooling said fluid G by heat exchange with an external refrigerant M to at least partially liquefy fluid G;

b) Subcooling fluid G obtained from step a) by heat exchange with a first liquid fraction to obtain a subcooled liquefied fluid G, whereby said first liquid fraction is vaporized to form a first vaporized fraction;

c) Expanding said sub cooled liquefied fluid G to obtain an expanded liquid fluid G;

d) Separating said expanded liquid fluid G to obtain said first liquid fraction and a second liquid fraction.

2. A partial liquefaction process according to claim 1, wherein fluid G is natural gas and at least a portion of said first vaporized fraction is re-injected into a well from which said natural gas is recovered.

3. A partial liquefaction process according to claim 2, wherein said first vaporized fraction is compressed to a pressure sufficient to allow its re-injection into said well.

4. A partial liquefaction process according to claim 1, wherein said second liquid fraction is expanded to a storage pressure and thereby partially vaporized.

5. A partial liquefaction process according to claim 1, wherein said first vaporized fraction is obtained by vaporization at different decreasing pressures.

6. A partial liquefaction process according to claim 1, wherein the quantity of said second liquid fraction is 20%–80% by weight of the quantity of said fluid G cooled in step a).

7. A partial liquefaction process according to claim 1, wherein cooling in step a) is carried out in at least two heat exchange zones using an external refrigerant M which is expanded and vaporized at decreasing pressures.

8. A partial liquefaction process according to claim 7, wherein external refrigerant M comprises at least one hydrocarbon.

9. A partial liquefaction process according to claim 8, wherein external refrigerant M comprises at least one hydrocarbon selected from the group consisting of methane, ethane, propane and butanes.

10. A partial liquefaction process according to claim 9, wherein external refrigerant M comprises methane, ethane, propane and at least one butane.

11. A partial liquefaction process according to claim 8, wherein refrigerant M comprises at least two hydrocarbons.

12. A partial liquefaction process according to claim 1, wherein the at least partially liquefied fluid G obtained from step a) is a condensed single phase.

13. A partial liquefaction process according to claim 1, wherein the at least partially liquefied fluid G obtained from step a) is a dense phase.

14. A partial liquefaction process according to claim 1, wherein fluid G is a natural gas and the at least partially liquefied fluid G obtained from step a) is at a temperature of less than −40° C.

15. A partial liquefaction process according to claim 1, wherein said first vaporized fraction is compressed and then used in a gas turbine to produce electricity.

16. A partial liquefaction process according to claim 1, wherein, further comprising:

e) Expanding a fraction of the partially liquefied fluid G from step a) and sending said fraction to the head of a fractionation column;

f) Compressing, cooling and sending said first vaporized fraction to the bottom of said fractionation column; and g) Mixing the liquid obtained from the bottom of said fractionation column with at least partially liquefied fluid G from step a).

17. A partial liquefaction process according to claim 1, wherein, before step b), the at least partially liquefied fluid G is dried and fractionated in at least two fractionation columns.

18. A partial liquefaction process according to claim 17, wherein products leaving the bottom of said fractionation columns are cooled with an external refrigerant M.

19. A partial liquefaction process according to claim 1, wherein said second liquid fraction is expanded and sent directly to cryogenic storage.

20. A partial liquefaction process according to claim 1, wherein said second liquid fraction is expanded and sent to a denitrogenation column from which a purge stream and a liquid product stream are recovered.

21. A partial liquefaction process according to claim 1, wherein said first vaporized fraction is at least 10 wt % of the quantity of fluid G cooled in step a).

22. A partial liquefaction process according to claim 1, wherein in step d) expanded liquid fluid G is separated into said first liquid fraction, said second liquid fraction, and a third liquid fraction, and said third liquid fraction is expanded and then subjected to heat exchange with fluid G in step b).

23. A partial liquefaction process according to claim 1, wherein cooling in step a) is performed using an eternal refrigerant M.

* * * * *